US005230448A

United States Patent [19]

Strohmeyer et al.

[11] Patent Number: 5,230,448

[45] Date of Patent: Jul. 27, 1993

[54] COMPLETE SYSTEM SELF-CONTAINED DRINK AND ICE DISPENSING

[75] Inventors: Darwin L. Strohmeyer, Bulverde; Samuel E. Brown, San Antonio, both of Tex.

[73] Assignee: Lancer Corporation, San Antonio, Tex.

[21] Appl. No.: 735,376

[22] Filed: Jul. 24, 1991

[51] Int. Cl.[5] ..... B67D 5/56; B67D 5/08

[52] U.S. Cl. ..... 222/643; 62/344; 222/129.1; 222/146.6; 222/227; 222/236; 222/413

[58] Field of Search ..... 222/146.6, 129.2–129.4, 222/227, 236, 238, 252, 254, 278, 412, 413, 638–643; 62/233, 137, 344, 389–397

[56] References Cited

U.S. PATENT DOCUMENTS

| | | | |
|---|---|---|---|
| 3,215,312 | 11/1965 | Guzzi | 222/146.6 X |
| 3,858,765 | 1/1975 | Landers | 222/146.6 X |
| 3,949,902 | 4/1976 | Thompson | 222/129.1 |
| 4,592,490 | 6/1986 | McMichael | 222/146.6 X |
| 4,687,120 | 8/1987 | McMillin | 222/146.6 X |
| 4,846,381 | 7/1989 | Kito et al. | 222/643 X |
| 5,054,654 | 10/1991 | Schroeder et al. | 222/146.6 |
| 5,104,007 | 4/1992 | Utter | 222/146.6 |

*Primary Examiner*—Kevin P. Shaver
*Attorney, Agent, or Firm*—Donald R. Comuzzi

[57] ABSTRACT

A complete self-contained drink and ice dispensing system which is portable and fulfills all the drink dispensing needs of a drink server is provided. All the components necessary to dispense a drink including ice are housed in a single compact unit which is extremely space efficient. These components include an ice maker which resides above a storage bin and a cold plate resting in the bottom of the storage bin. The ice maker supplies both the ice dispensed with the drinks as well as the ice used to cool the cold plate. Situated between the product source and cold plate are pumps which pump product to dispensing valves for dispensing into cups. Additionally, a water pump and carbonator are positioned between a water source and the cold plate to provide the carbonated water dispensed with the product. The product source, water source, water pump, carbonator, product pumps, cold plate, and dispensing valves are all fluidly connected by product lines. The complete self-contained drink and ice dispensing system further includes an outer housing that is fitted with lid and cup holders and a straw holder so that all the necessary supplies for a completely dispensed drink are supplied.

8 Claims, 3 Drawing Sheets

COMPLETE SYSTEM SELF-CONTAINED DRINK AND ICE DISPENSING

BACKGROUND OF THE INVENTION

The invention relates to an apparatus for dispensing both ice and chilled beverages, and more particularly, but not by way of limitation, to a complete self-contained drink center capable of furnishing all the drink dispensing needs of any drink server.

Available space is a valuable commodity in small convenience stores, cafeterias, concession stands, fast food service lines, and the like. The relevant industry sets certain size and dimensional requirements based on space limitations of service counters and the ease of everyday operation and routine maintenance. The industry is constantly looking for improved apparatus which take up less counter space while delivering the same or increased levels of efficiency. Small, compact machines, facilitating the delivery of food service and suitable for service counters of set and limited dimensions, are constantly in demand. Ice in chilled beverages has become a necessary part of modern day food service, and a combined ice and chilled beverage dispenser, logically, increases efficiency in food service delivery by eliminating the need for two separate machines and by making more counter space available.

One such system is disclosed in U.S. Pat. No. 5,054,654 issued on Oct. 5, 1991 to Schroeder and assigned to the assignee of the present invention. That system has the dispensing valves, ice dispenser, and cold plate packaged into a single unit. However, that unit must still be used in combination with additional dispensing apparatus such as a carbonator, dispensing valve pumps, an ice maker, etc. Those additional dispensing apparatus take up valuable counter space which could be used for a different purpose. Furthermore, the Schroeder ice and beverage dispenser and, in fact, many conventional beverage dispenser are not very portable and cannot be used to completely service all the drink dispensing needs of a drink server. Thus, the present invention which is a single self-contained drink center having all the necessary elements so that only a product source need be connected to begin serving drinks has been designed.

Additionally, of particular interest in the drink dispensing industry is the reduction of operating costs for existing or new markets. For example, any person desiring to open a food service establishment will be extremely concerned about space, especially with the high rent prices of presently available commercial property. Also, any current food and drink server wishing to expand will encounter the same concerns. Furthermore, with the advent of the European common market, an entirely new customer has been created. Presently, the European food service industry typically dispenses its soda products in bottles; consequently no counter space is available for drink dispensing equipment. The complete drink center of the present invention will allow drinks to be dispensed in an easy, cost effective and inexpensive manner in such establishments without expensive remodeling. Another industry where the present invention will be used is convenience stores. Recently, many existing convenience stores have added food products such as microwavable sandwiches and pizza. To complement such products drinks must also be served. However, counter space for conventional drink dispensers is unavailable.

Therefore, it is an object of the present invention to provide a portable single complete drink center that is compact and will service all the drink dispensing needs of a drink server.

SUMMARY OF THE INVENTION

The present invention provides a significant improvement over conventional drink dispensing apparatus because its compact size makes it nearly half as large. The present invention allows drinks to be served from a single complete drink center. The complete drink center is portable and may be positioned in any available space about a restaurant or cafe. Once positioned, the drink center is connected to a product source and is then ready to dispense drinks. A person wishing to receive a drink merely takes a cup from one of the cup holders and fills it with ice and dispenses the desired drink. Afterward, a lid and straw can be retrieved from an additional holder on the dispensing unit.

To provide the complete drink center, the present invention is fitted with an ice maker residing above an ice storage bin which has a cold plate resting in the bottom. The ice maker provides the ice necessary to supply both the ice required in the drinks as well as providing the cooling necessary for the cold plate. Situated between the product source and cold plate are the pumps necessary to provide the pressure to dispense the product. Additionally, a water pump and carbonator are positioned between a water source and the cold plate to provide the carbonated water necessary when mixing the drinks. The product source, water source, water pump, carbonator, product pumps, cold plate, and dispensing valves are all fluidly connected by product lines.

The present invention is of a size and configuration such that it takes up less space than any other conventional dispensing unit while providing all the required dispensing needs of a drink server in a portable single complete unit.

Other objects, features, and advantages of this invention will become evident in light of the following description of the invention.

DETAILED DESCRIPTION OF THE PREFERRED EMBODIMENT

Figure 1:
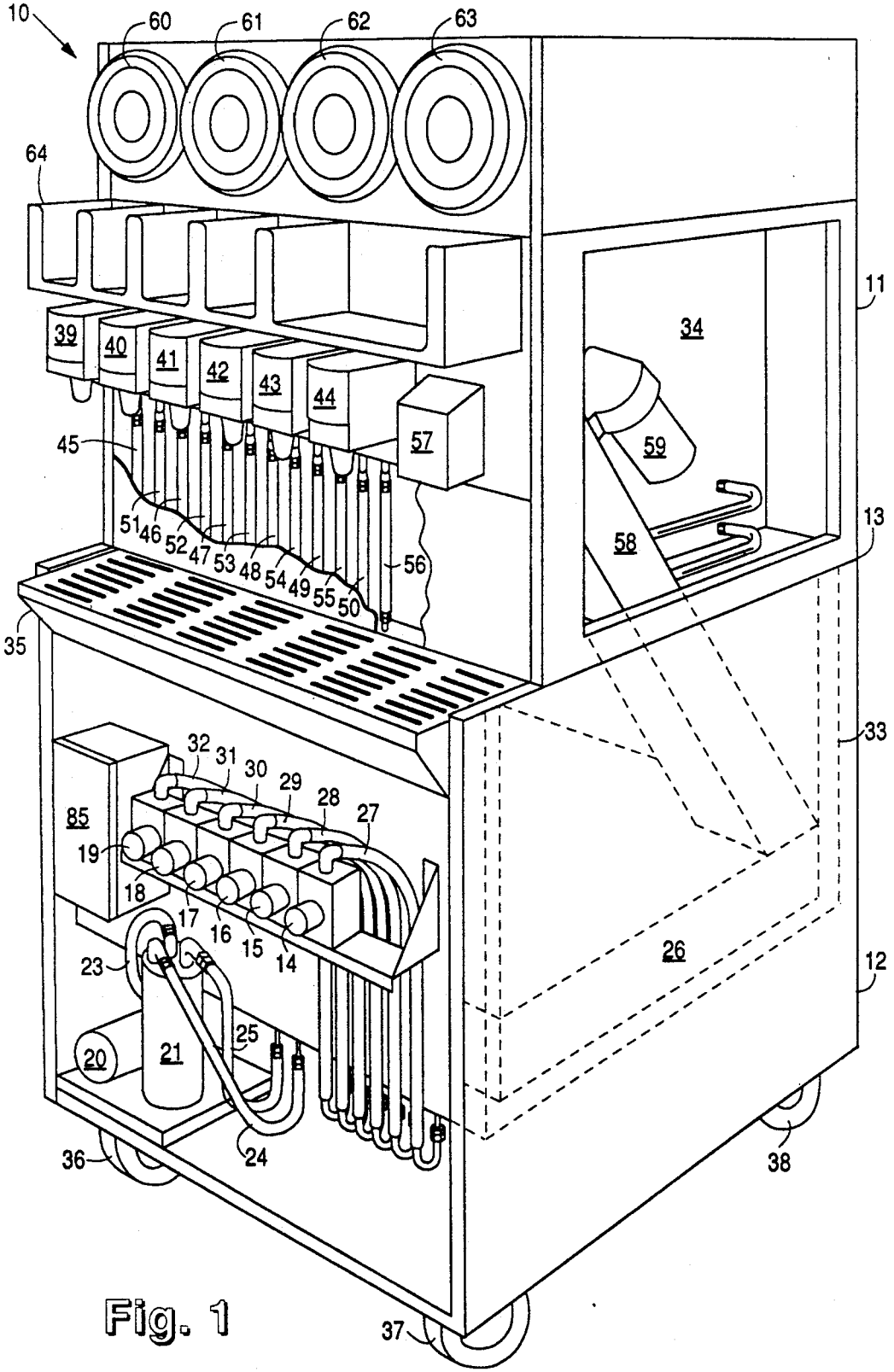
FIG. 1 depicts a perspective view of the complete drink center of the present invention with a cut-away perspective view into the interior, showing the internal components contained in the preferred embodiment of the complete drink center.

Referring to FIG. 1, the complete drink center of the preferred embodiment of the present invention will be disclosed. Drink center 10 comprises outer housing 13 which is divided into upper unit 11 and lower unit 12. A product source (not shown) is connected to product pumps 14 through 19 via product lines (not shown) to provide product for dispensing. The product source is a typical "bag in the box" type, however, any conventional product source container and delivery means could be used.

Additionally, lower unit 12 is fitted with motor 20 attached to a water pump (not shown) and carbonator 21. Motor 20 is connected to a power source (not shown) via control box 85. Operation of control box 85 will be discussed herein with reference to FIG. 3. The input line of the pump is connected to a water source (not shown). Output line 23 of the pump is fluidly connected to the water input of carbonator 21. The CO2 input of carbonator 21 is connected to a CO 2 source (not shown) via CO2 line 24. Carbonator 21 is a conventional unit used to introduce CO2 into water to develop carbonated water. The resultant carbonated water is pumped to cold plate 26 via carbonated water line 25.

The product pumped from the product source (not shown) by product pumps 14–19 is also transferred to cold plate 26 via product lines 27–32. Product pumps 14–19 are provided power from a power source (not shown) via control box 85.

Cold plate 26 is of any conventional type. Cold plate 26 resides in the bottom of ice bin 33 which is part of lower unit 12. Ice bin 33 resides below ice maker 34 which is housed in upper unit 11. Ice maker 34 is connected to a power source via control box 85 and is of any conventional type. Ice bin 33 holds the ice which is used in the dispensed drinks as well as to provide the cooling for cold plate 26 that is necessary to ensure that the dispensed drinks are below an acceptable dispensing temperature. In addition, cold plate 26 is provided with a drain hole (not shown) connected to a drain (not shown) for draining off water collected in ice bin 33 as a result of melting ice.

Lower unit 12 is further provided with catch pan 35 connected to a drain (not shown) and used to catch and dispose of excess dispensed product or ice. To provide portability, dispensing unit 10 is provided with wheels 36–38 and a fourth (not shown) attached by any conventional means such as a nut and bolt to the underneath of lower unit 12.

Cold plate 26 is further connected to dispensing/mixing valves 39–44 via product lines 45–50 and carbonated water lines 51–56. Dispensing/mixing valves 39–44 are of any conventional type used to mix the product with carbonated water before final dispensing. Dispensing-/mixing valves are activated using a membrane switch; however any conventional switch could be used. When one of the membrane switches is pushed, control box 85 delivers power to the selected product pump of product pumps 14–19 and motor 20 to deliver product and carbonated water to that dispensing/mixing valve.

Upper unit 11 is further provided with ice dispenser 57 which is connected to ice ramp 58 via a chute (not shown) to provide the ice dispensed with the product. Ice ramp 58 is powered by motor 59 and descends into ice bin 33 to raise ice up to ice dispenser 57. The functioning of ice dispenser 57 and ice ramp 58 will be discussed herein with reference to FIG. 2.

To provide a complete dispensing unit, upper unit 11 is provided with cup holders 60–63 to provide the dispenser user with a choice in drink size. Additionally, upper unit 11 is provided with lid and straw holder 64 so that all the necessary supplies for a completely dispensed drink are provided.

Figure 2:
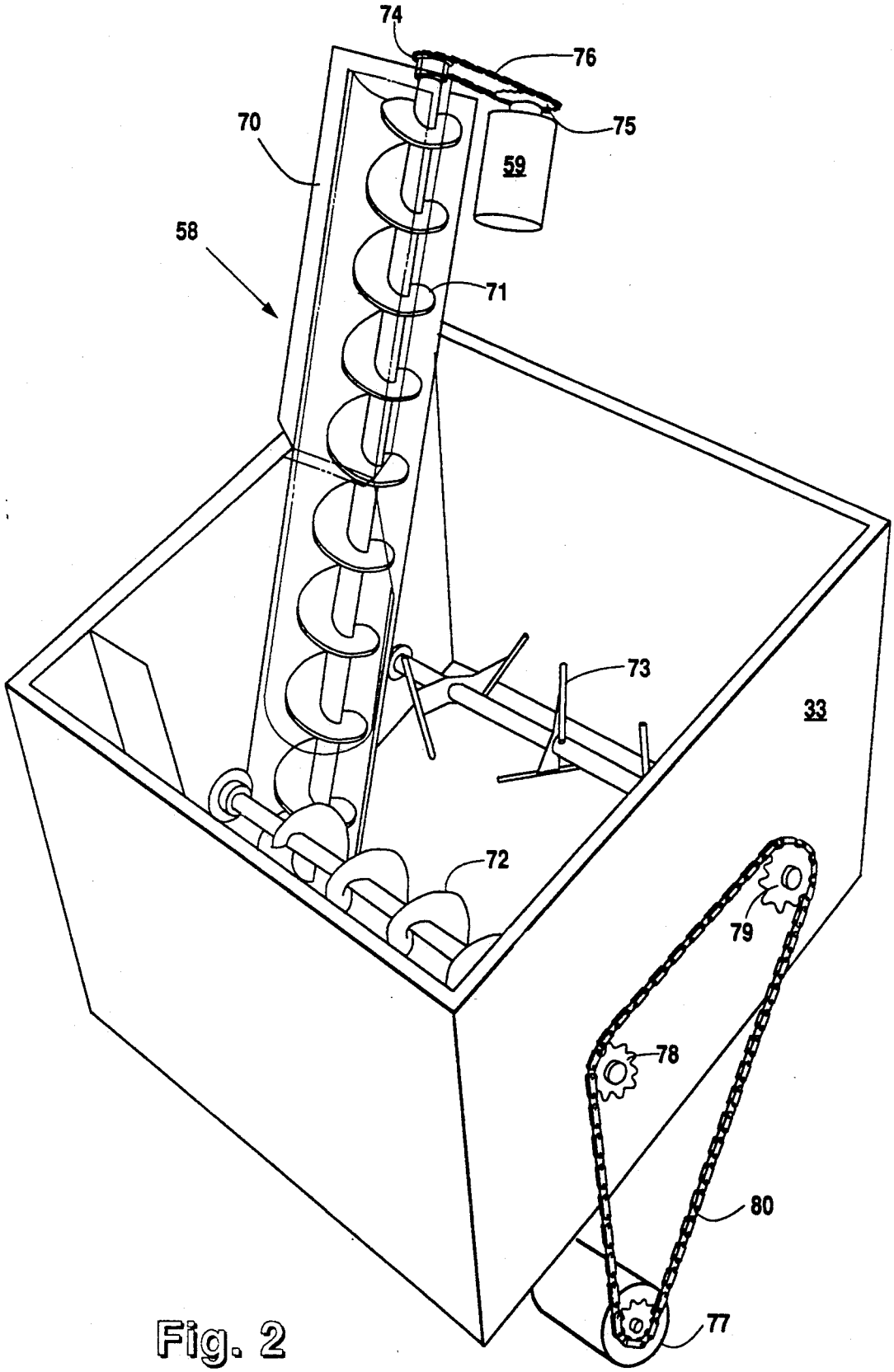
FIG. 2 depicts a perspective view of the ice bin showing the ice agitator and ice lifting apparatus.

Referring to FIG. 2, the operation of ice dispenser 57 and ice ramp 58 will be disclosed. Ice dispensing ramp 58 is comprised of an outer shield 70 which houses auger 71 which raises ice up to the chute of ice dispenser 57. Motor 59 is connected to shaft sprocket 74 of auger 71 from its sprocket 75 via chain 76. Ice dispenser 57 is provided with a membrane switch which activates motor 59 when pushed. As motor 59 rotates, auger 71 is rotated which causes the ice to be lifted u the flanges of auger 71 as they rotate to dump ice out of ice dispenser 57 into a cup held below via the ice chute. Motor 59 is connected to a power source (not shown) via control box 85.

Ice bin 13 is further provided with auger 72 and ice mixer 73 powered by motor 77 which is fixed underneath ice bin 13 and connected to a power source (not shown) via control box 85. As motor 77 rotates, auger 72 and ice mixer 73 are rotated via sprockets 78 and 79 through chain 80. Auger 72 is provided in ice bin 33 in order to move the ice towards auger 71 so that it can be raised to ice dispenser 57. The flanges provided about the shaft of auger 72 push the ice in that direction. Ice mixer 73 is provided with a number of rods connected to the shaft of ice mixer 73 by tabs so that the ice is stirred as ice mixer 73 rotates Ice mixer 73 is provided in bin 33 in order to keep the ice agitated and prevent it from freezing together.

Figure 3:
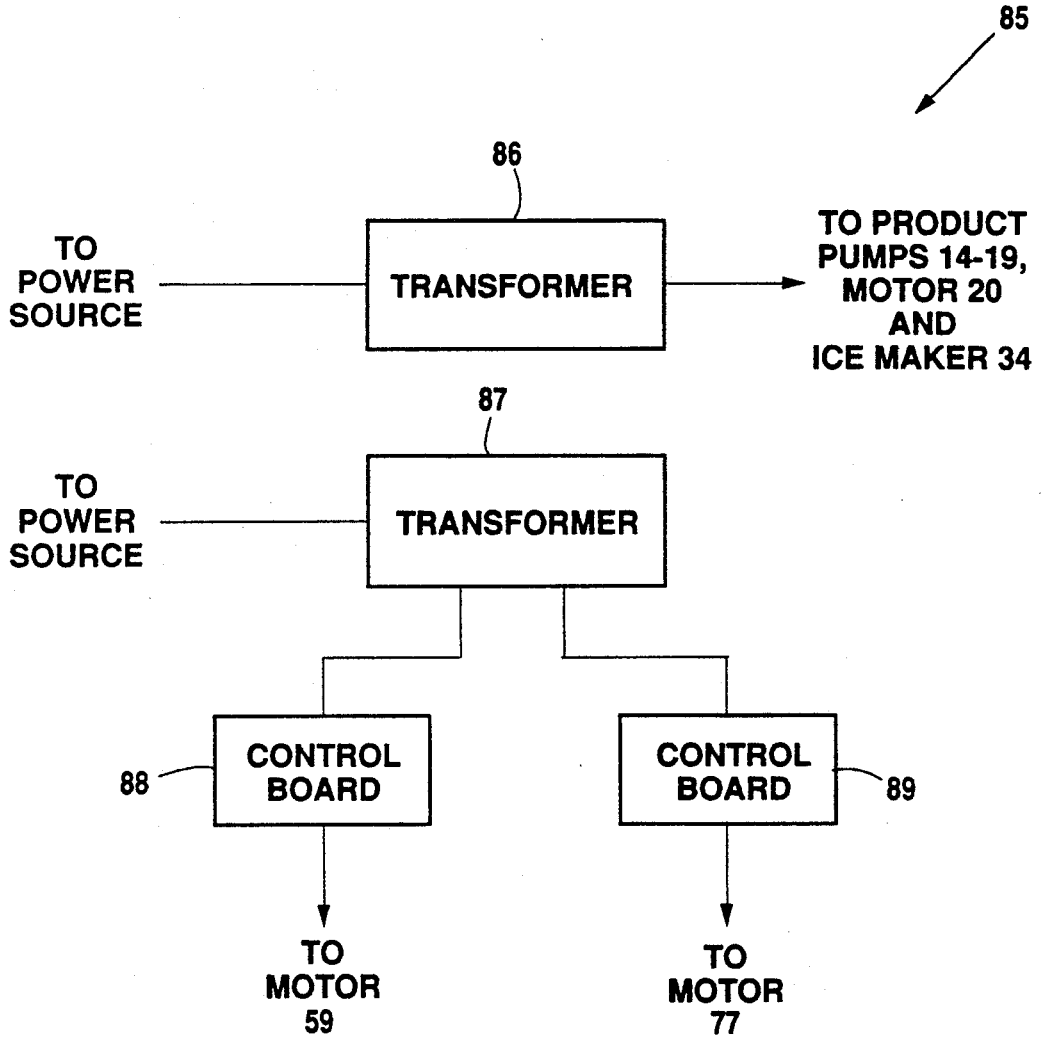
FIG. 3 depicts a schematic of the control system of the present invention.

Referring to FIG. 3, the operation of control box 85 will be disclosed. Control box 85 contains two transformers 86 and, 87, the inputs of which are connected to a conventional 115 V power source. Transformer 86 is used to provide the current and voltage transformations necessary to operate product pumps 14–19 and motor 20 and on a continual basis to ice maker 34. For actual drink dispensing, when any one of dispensing/mixing valves 39–44 is activated, power is delivered to the product pumps and carbonator to dispense a drink.

Transformer 87 merely provides the current and voltage transformations required to operate motors 59 and 77. Control board 88 is a simple control circuit used to deliver power to motor 59 either when the membrane switch on ice dispenser 57 is activated or on a timed interval basis. Control board 88 is constructed of conventional electronics used to supply power to a motor and includes a conventional timing circuit (not shown). The timing circuit consists of a first timer which is a programmable self-contained oscillator chip having internal divide circuitry. The output of the first timer input into a second timer which is a standard RC timer chip. In the preferred embodiment, the two chips used are a 4541 and a 555, respectively, manufactured by any chip manufacturing company such as Motorola or RCA. The first timer is used to determine when motor 59 is to be turned on (i.e. the activation interval). The second timer determines the length of time that motor 59 is activated. Both times are determined by the system user. The timing circuit periodically turns on motor 59 to rotate auger 71 so that ice will continually remain in the top flanges of auger 71 even in periods of little use. That is done to keep the time between the pressing of the membrane switch and the actual delivery of the ice to the cup at a minimum. Additionally, the first timer is provided with a reset that is activated when the membrane switch is pushed to reset the first timer because it is not necessary to periodically rotate auger 71 during periods of heavy use.

Control board 89 is constructed of exactly the same components and functions in a similar manner to control board 88 to deliver power to motor 77. Control board 89 also has a timing circuit which periodically activates motor 77 to rotate auger 72 and ice mixer 73. The only two differences between control board 89 and control board 88 is that control board 89 has different activation intervals, both when and how long, and its first timer is not reset in response to the pushing of the membrane switch on ice dispenser 57.

While the preferred embodiment of the present invention has been described for the purposes of this disclosure, changes in the design and arrangements can made by those skilled in the art, which changes are encompassed within the spirit of this invention as defined by the appended claims.

We claim:

1. A portable complete post-mix drink center for dispensing a product comprising:

an outer housing;

means for pumping product fluidly connected to and positioned between a product source and a means for cooling, said means for cooling housed within a means for storing ice;

means for carbonating water fluidly connected to and positioned between a water source, a CO2 source, and said means for cooling;

means for making particulate ice in communication with said means for storing ice;

drink dispensing means for dispensing said product and said carbonated water fluidly connected to said means for cooling;

means for dispensing ice communicating with said ice storage means, wherein said means for dispensing ice comprises:

a first auger housed within an enclosure for transporting ice from said means for storing ice to an ice dispensing chute, said first auger rotatably connected to a first drive means wherein ice is transported through said enclosure by said first auger as said first auger rotates, a second auger rotatably connected to a second drive means wherein ice is pushed by said second auger to an opening in said enclosure as said second auger rotates, an ice mixer rotatably connected to said second motor for agitating the ice particles to keep it from freezing together; and control means operably connected between a power source and said product pumping means, said means for carbonating water, said ice making means, and said ice dispensing means to control the delivery of power to said means, wherein said control means comprises:

a switch means to allow the manual activation of said first drive means to rotate said first auger and facilitate the dispensing of ice, and a first timing means for periodically turning on and off said first drive means to rotate said first auger, thereby ensuring ice remains in the flanges of said first auger nearest said ice dispensing chute.

2. The post-mix drink center according to claim 1, wherein said control means further comprises a second timing means for periodically turning on and off said second drive means to rotate said second auger and said ice mixer.

3. The post-mix drink center according to claim 2, wherein said control means further comprises:

a first transducer operably connected between said power source and said product pumping means, said ice making means, and said means for carbonating water for transforming the power delivered from said power source; and a second transformer operably connected between said power source and said first timing means and said second timing means for transforming the power delivered from said power source.

4. The post-mix drink center according to claim 1, wherein said first timing means comprises a reset means which resets said first timing means in response to the activation of said switch means.

5. The drink dispensing unit according to claim 1 wherein said means for cooling is a cold plate.

6. The dispensing unit according to claim 1 wherein said ice storage means is an ice bin.

7. The drink dispensing unit according to claim 1 wherein said means for carbonating water comprises:

a water pump fluidly connected between said water source and a carbonator; and said carbonator further being connected between said CO2 source and a cold plate.

8. The post-mix drink center according to claim 1 further comprising means for holding drink cups, lids, and straws connected to said outer housing.

* * * * *